US012753032B2

(12) United States Patent
Yokoyama

(10) Patent No.: US 12,753,032 B2
(45) Date of Patent: Oct. 6, 2026

(54) PAPER FEEDING DEVICE INCLUDING MULTI-TRAY AND PAPER FEEDING CASSETTE AND IMAGE FORMING APPARATUS HAVING THE SAME

(71) Applicant: KYOCERA Document Solutions Inc., Osaka (JP)

(72) Inventor: Koki Yokoyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 220 days.

(21) Appl. No.: 18/662,234

(22) Filed: May 13, 2024

(65) Prior Publication Data

US 2024/0383704 A1 Nov. 21, 2024

(30) Foreign Application Priority Data

May 16, 2023 (JP) ..... 2023-081114

(51) Int. Cl.
*B65H 7/06* (2006.01)

(52) U.S. Cl.
CPC ..... *B65H 7/06* (2013.01); *B65H 2405/121* (2013.01); *B65H 2405/324* (2013.01); *B65H 2513/52* (2013.01); *B65H 2551/21* (2013.01); *B65H 2601/11* (2013.01)

(58) Field of Classification Search
CPC ..... B65H 1/266; B65H 2402/60; B65H 2405/121; B65H 2405/324; B65H 2407/20; B65H 2407/21
See application file for complete search history.

(56) References Cited

U.S. PATENT DOCUMENTS

| | | | | |
|---|---|---|---|---|
| 6,179,499 | B1 * | 1/2001 | Beretta | B65H 1/266 400/605 |
| 7,322,763 | B2 * | 1/2008 | Yang | B65H 1/266 271/145 |
| 7,631,861 | B2 * | 12/2009 | Takahashi | B41J 13/103 271/171 |
| 7,967,287 | B2 * | 6/2011 | Hamasaki | B65H 1/266 271/223 |
| 8,851,466 | B2 * | 10/2014 | Kotaka | B65H 3/0669 271/9.08 |
| 9,278,553 | B2 * | 3/2016 | Nakano | B41J 11/02 |
| 10,227,192 | B2 * | 3/2019 | Tatematsu | B65H 5/36 |
| 10,289,059 | B2 * | 5/2019 | Soda | B65H 1/266 |

(Continued)

FOREIGN PATENT DOCUMENTS

JP H0858993 A 3/1996

*Primary Examiner* — Howard J Sanders
(74) *Attorney, Agent, or Firm* — IP Business Solutions, LLC.

(57) ABSTRACT

In a paper feeding device, a paper feeding cassette and a multi-tray are disposed to be freely inserted or extracted separately, a hook is disposed in the paper feeding cassette, and an engagement part is disposed in the multi-tray. In a state in which the paper feeding cassette and the multi-tray are pushed into and housed on the inside of a device main body, when a lever is operated, and the hook is moved in an upward direction against a biasing force of a coil spring, the hook is engaged with the engagement part, and, in this state, when the paper feeding cassette is drawn out, the hook moves the engagement part, and the multi-tray is drawn out together with the paper feeding cassette.

7 Claims, 8 Drawing Sheets

(56) References Cited

U.S. PATENT DOCUMENTS

| | | | | |
|---|---|---|---|---|
| 2004/0190934 | A1* | 9/2004 | Okabe | G03G 21/1821 399/111 |
| 2010/0172678 | A1* | 7/2010 | Kim | G03G 15/6502 399/393 |
| 2016/0137444 | A1* | 5/2016 | Kasaishi | B65H 1/266 271/10.09 |

* cited by examiner

PAPER FEEDING DEVICE INCLUDING MULTI-TRAY AND PAPER FEEDING CASSETTE AND IMAGE FORMING APPARATUS HAVING THE SAME

INCORPORATION BY REFERENCE

This application claims priority to Japanese Patent Application No. 2023-081114 filed on May 16, 2023, the entire contents of which are incorporated by reference herein.

BACKGROUND

The present disclosure relates to a paper feeding device having a multi-tray and a paper feeding cassette and an image forming apparatus including the paper feeding device and, more particularly, to a technology for integrally pulling out a multi-tray and a paper feeding cassette.

There is an image forming apparatus that includes a paper feeding cassette and a multi-tray supplying a recording sheet on which an image is formed in which the paper feeding cassette and the multi-tray are arranged to vertically overlap each other. In addition, an image forming apparatus that includes a multi-size cassette in which sheet members of two kinds of sizes are adjacently aligned and are loaded and each pickup roller pulling out and supplying a sheet material of any one size from the multi-size cassette and enables supply of sheet members of two kinds of sizes from one multi-size cassette is further known as well.

SUMMARY

As one aspect of the present disclosure, a technology acquired by further improving the technology described above is proposed.

A paper feeding device according to one aspect of the present disclosure includes a paper feeding cassette, a multi-tray, a hook, a biasing member, and an engagement part. The paper feeding cassette described above is disposed to be freely inserted into or extracted from a device main body. The multi-tray described above is arranged on an upper side of the paper feeding cassette and is disposed to be freely inserted into or extracted from the device main body. The hook described above is disposed to be freely moved in a vertical direction in the paper feeding cassette. The biasing member described above is disposed in the paper feeding cassette and biases the hook to a lower side. The engagement part described above is disposed in the multi-tray and engaged with the hook when the hook is operated and is moved in an upward direction against a biasing force of the biasing member in a state in which the paper feeding cassette and the multi-tray are pushed into and housed on an inside of the device main body. When the paper feeding cassette is pulled out in a state in which the hook is engaged with the engagement part, the multi-tray is pulled out together with the paper feeding cassette.

An image forming apparatus according to one aspect of the present disclosure includes: the paper feeding device according to one aspect of the present disclosure; and an image forming device forming an image on paper that is pulled out and supplied from the paper feeding cassette or the multi-tray of the paper feeding device.

DETAILED DESCRIPTION

Figure 1:
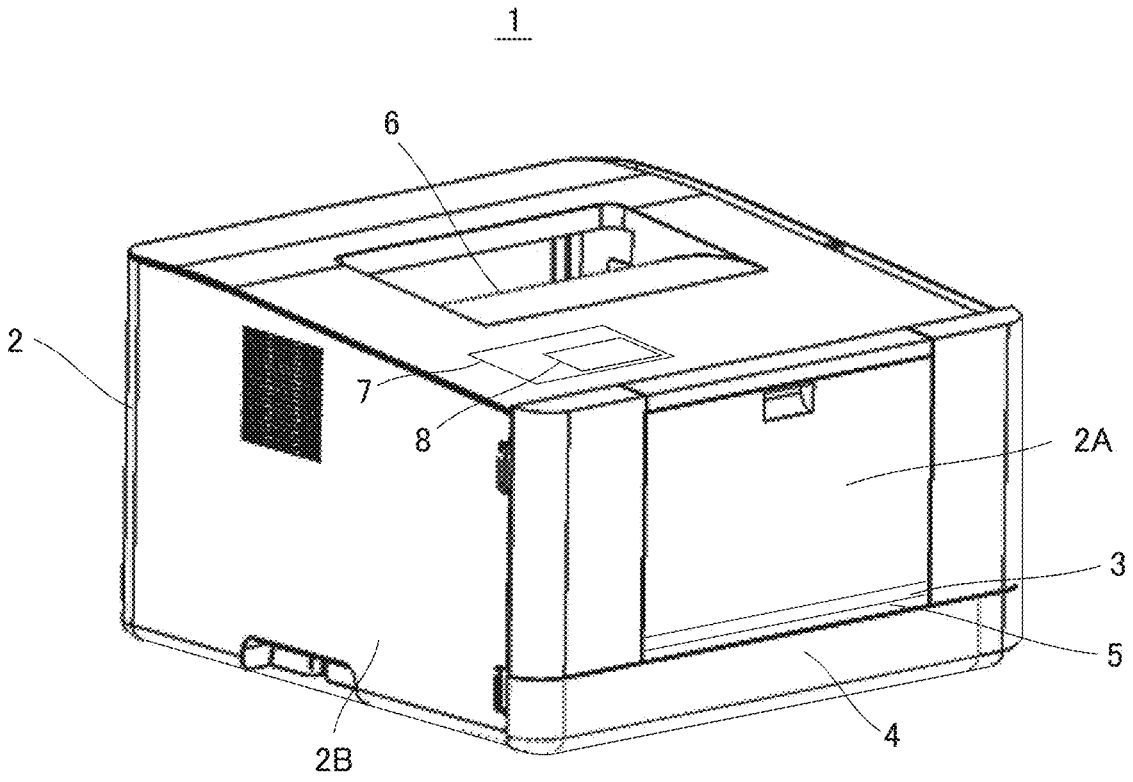
FIG. 1 is a perspective view illustrating an external appearance of an image forming apparatus to which a paper feeding device according to one embodiment of the present disclosure is applied.

Hereinafter, an embodiment of the present disclosure will be described with reference to the drawings. FIG. 1 is a perspective view illustrating an external appearance of an image forming apparatus to which a paper feeding device according to one embodiment of the present disclosure is applied. Hereinafter, although there is a case in which a rotation direction or leftward, rightward, upward, and downward directions are illustrated, unless particularly mentioned otherwise, these illustrate directions as one example of each diagram.

As illustrated in FIG. 1, the image forming apparatus 1, for example, is a printer, a paper feeding cassette 4, a multi-tray 5, a discharge tray 6, an operation panel 7, a display device 8, and the like are disposed in a device main body 2, and, inside the device main body 2, an image forming device, a fixing device (not illustrated), and the like are disposed.

The image forming device forms an image represented by image data on a recording sheet supplied from the paper feeding cassette 4 or the multi-tray 5 using an electrophotographic method that uses toner. A recording sheet for which image formation has been completed receives a fixing process according to the fixing device and then is discharged to the discharge tray 6.

Figure 2:
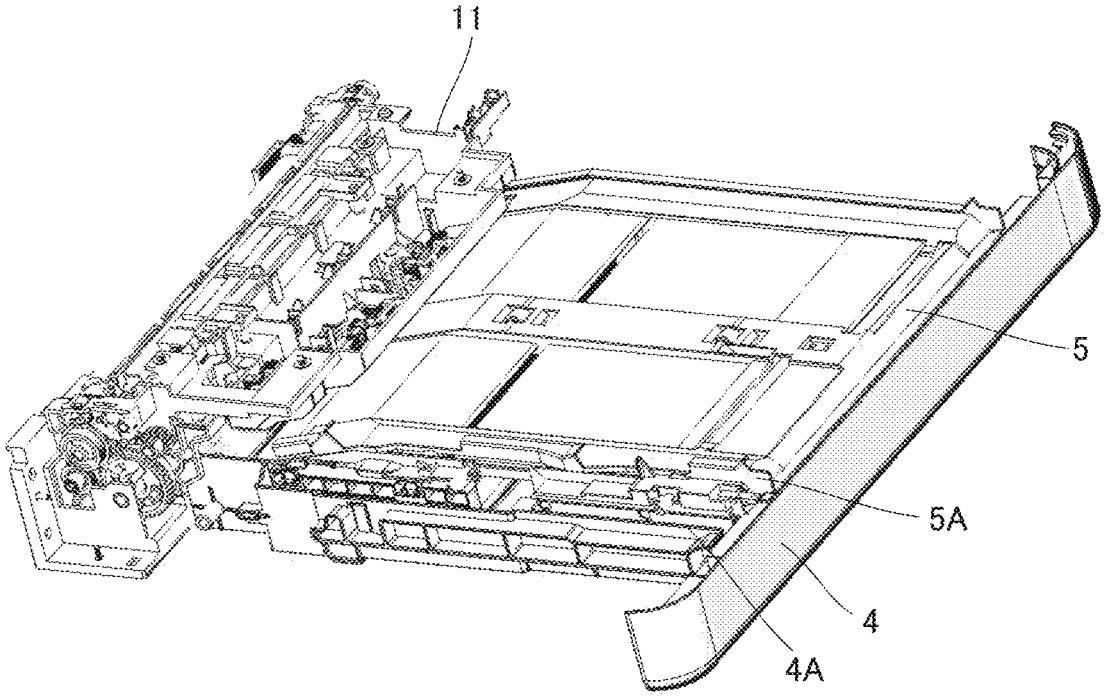
FIG. 2 is a perspective view illustrating a paper feeding device according to this embodiment.
Figure 3:
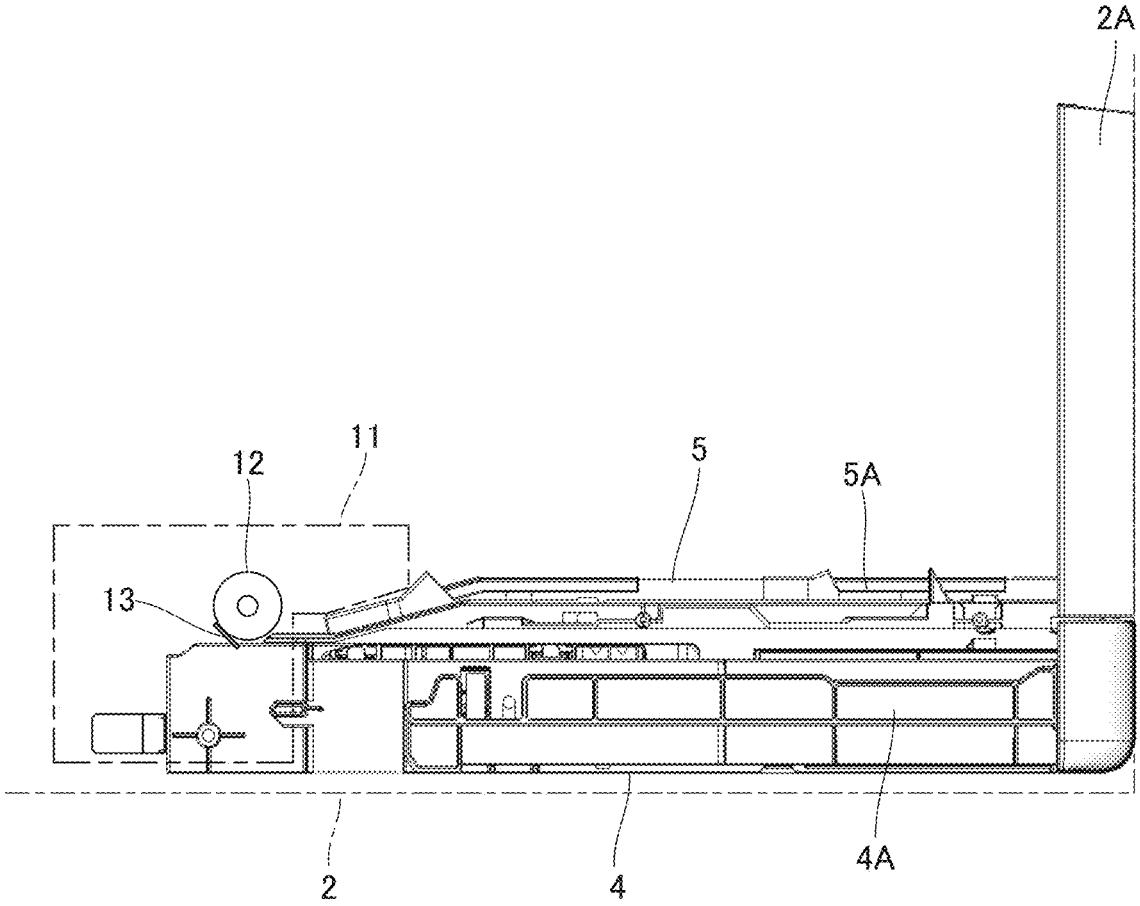
FIG. 3 is a side view illustrating the paper feeding device according to this embodiment.

FIG. 2 is a perspective view illustrating a paper feeding device according to this embodiment. In addition, FIG. 3 is a side view illustrating the paper feeding device according to this embodiment. As illustrated in FIGS. 2 and 3, the paper feeding device 10 includes a paper feeding cassette 4, a multi-tray 5, and a paper pulling-out device 11. In the paper feeding cassette 4, a plurality of recording sheets having standard sizes are placed and loaded.

On a front side of the device main body 2 of the image forming apparatus 1, an opening/closing door 2A is disposed as a part of a wall part forming the device main body 2. In the opening/closing door 2A, a lower end portion of this wall part is supported to be freely rotated in a direction for approaching or being separated from the device main body 2. On the front side of the device main body 2, a slit 3 for enabling the opening/closing door 2A to be rotated with respect to the device main body 2 is formed.

When the opening/closing door 2A of the front face of the device main body 2 is open, and the inside of the device main body 2 is in an open state, recording sheets of non-standard or standard sizes are manually inserted and placed into the multi-tray 5 by a user.

The paper pulling-out device 11 includes a paper feeding roller 12 and a handling pad 13. In a case in which a recording sheet is not placed in the multi-tray 5, the paper feeding roller 12 is rotated with being brought into contact with a tip end of a recording sheet of an uppermost layer of the paper feeding cassette 4, and the recording sheet is pulled out by the paper feeding roller 12 and is conveyed to an image forming device inside the device main body 2 through a space between this paper feeding roller 12 and the handling pad 13.

In addition, in a case in which a recording sheet is placed in the multi-tray 5, the paper feeding roller 12 is rotated with being brought into contact with a tip end of the recording sheet disposed on the multi-tray 5, and the recording sheet is pulled out by the paper feeding roller 12 and is conveyed to the image forming device through a space between this paper feeding roller 12 and the handling pad 13.

The paper feeding cassette 4 is disposed to be freely inserted or extracted inside and outside the device main body 2 in an opening part (not illustrated) disposed in a lower part of the front side of the device main body 2. In addition, the multi-tray 5 is arranged to overlap an upper side of the paper feeding cassette 4 and is disposed to be freely inserted into or extracted from this opening part.

For example, one pair of guide rails are disposed on inner faces of walls 2B (illustrated in FIG. 1) of both sides of the device main body 2 that face each other, both sides of a frame part 4A of the paper feeding cassette 4 are supported to freely slide using one pair of guide rails, and the paper feeding cassette 4 is disposed to be freely inserted or extracted. Similarly, another one pair of guide rails are disposed on the inner faces of the walls 2B of both sides of the device main body 2 that face each other, both sides of a frame part 5A of the multi-tray 5 are supported to freely slide using the other one pair of guide rails, and the multi-tray 5 is disposed to be freely inserted or extracted.

Figure 4A:
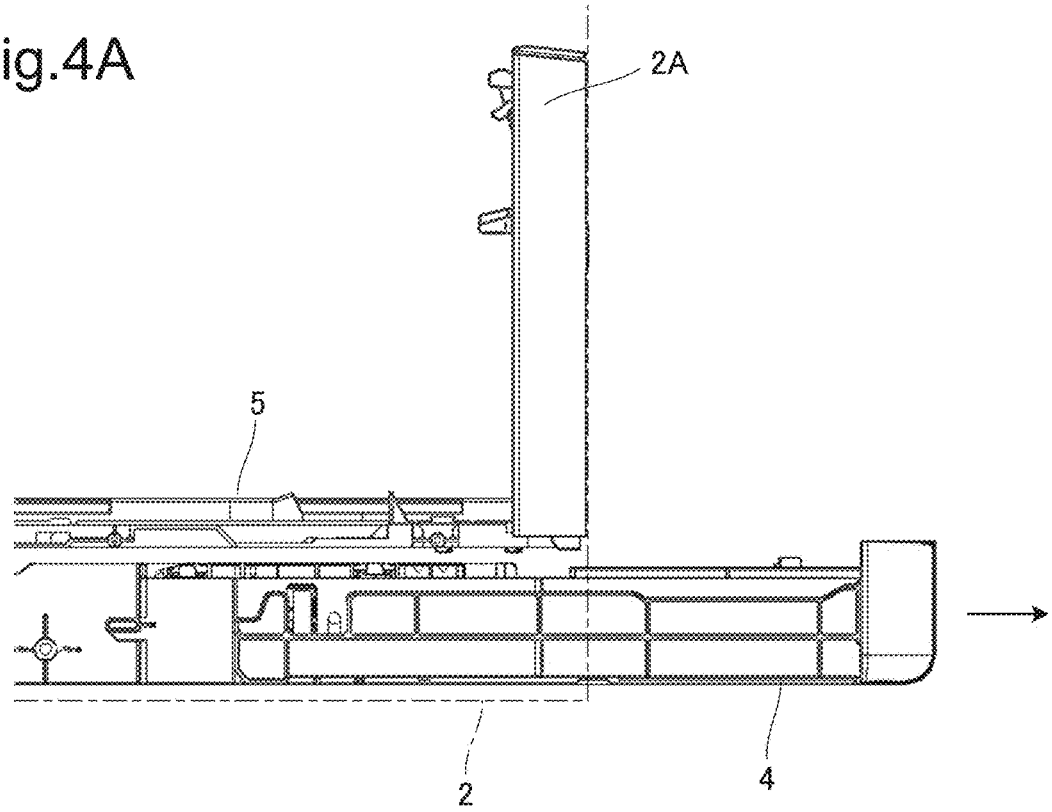
FIG. 4A is a side view illustrating a state in which only a paper feeding cassette is pulled out from a device main body.
Figure 4B:
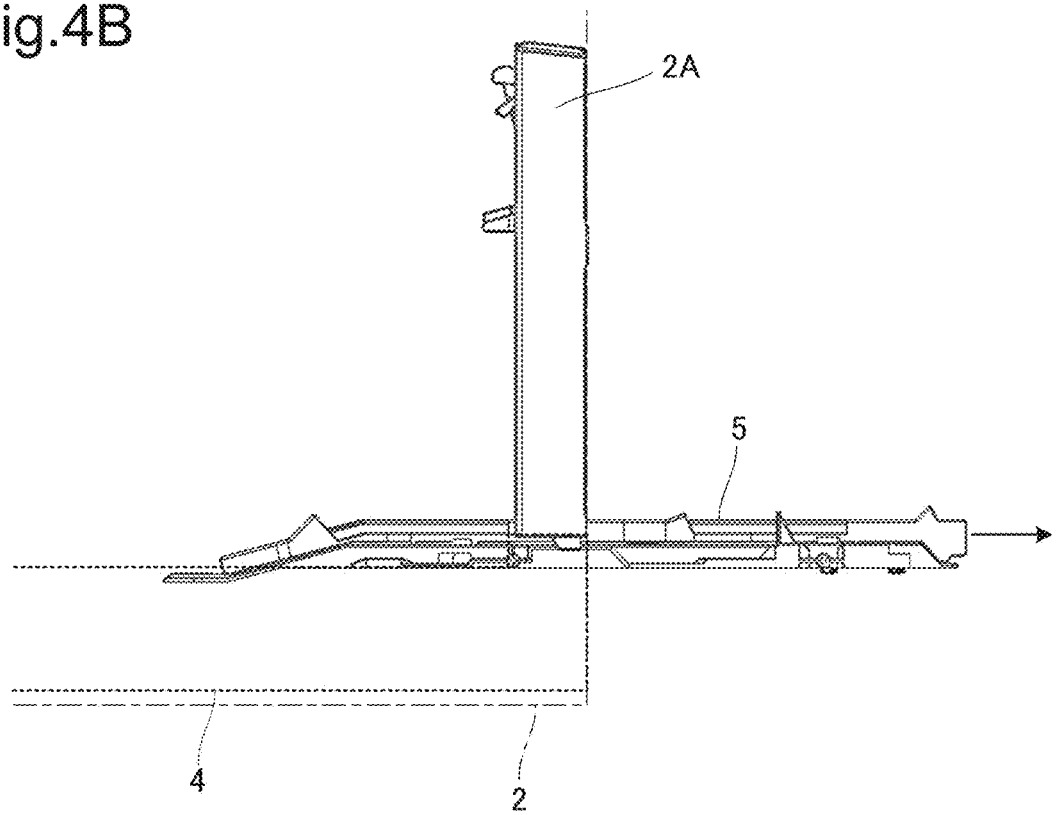
FIG. 4B is a side view illustrating a state in which only a multi-tray is pulled out from the device main body.

As illustrated in FIG. 4A, only the paper feeding cassette 4 is drawn out from the device main body 2, a plurality of recording sheets are loaded and housed in the paper feeding cassette 4, and the paper feeding cassette 4 is pushed and housed in the inside of the device main body 2 to return to the original state. In addition, as illustrated in FIG. 4B, it can be configured such that only the multi-tray 5 is drawn out from the device main body 2, and the multi-tray 5 is pushed in and housed on the inside of the device main body 2 to return to the original state.

Figure 5A:
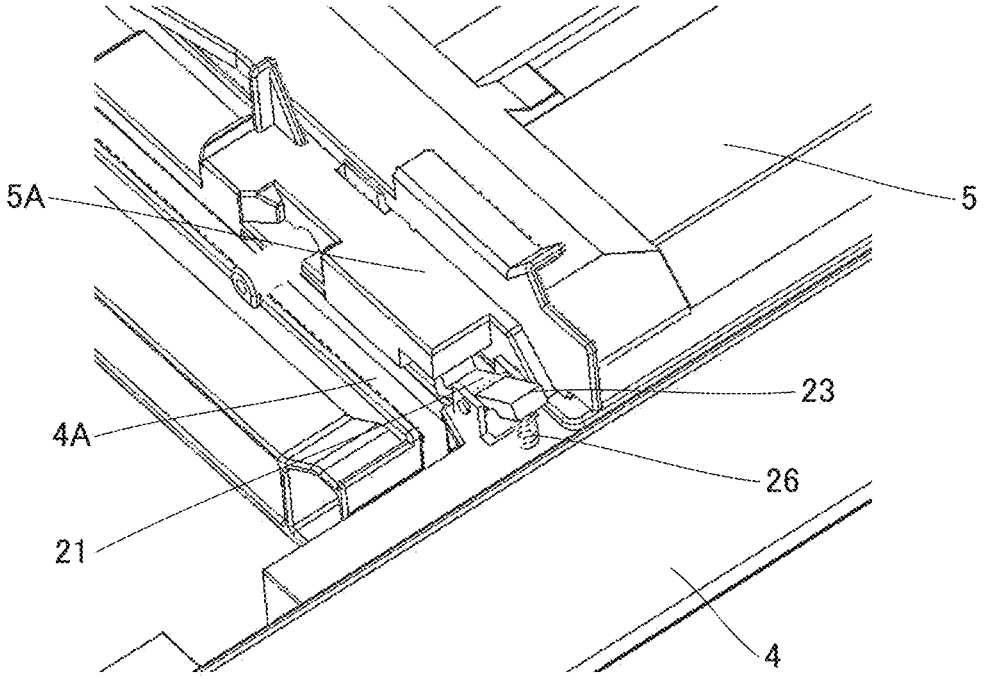
FIG. 5A is a perspective view illustrating a lever and the like disposed in a paper feeding cassette.
Figure 5B:
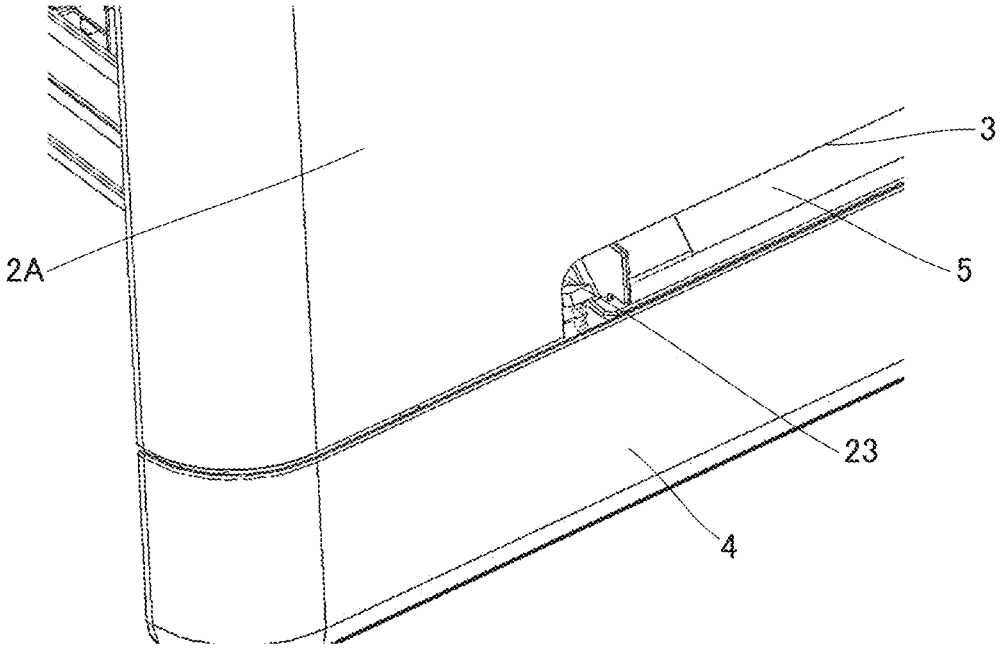
FIG. 5B is a perspective view illustrating a view in which a lever is seen through a slit of a wall of a front face of a device main body.

As illustrated in FIG. 5A, at one side end of the frame part 4A of the paper feeding cassette 4, the lever 21 is disposed. The lever 21 is arranged under one side end of the frame part 5A of the multi-tray 5. As illustrated in FIG. 5B, a part (an operation part) of the lever 21 is exposed to the outside of the device main body 2 through the slit 3 in a state in which the opening/closing door 2A is closed for the front side of the device main body 2. In accordance with this, an operation on the lever 21 can be performed through the slit 3.

Figure 6A:
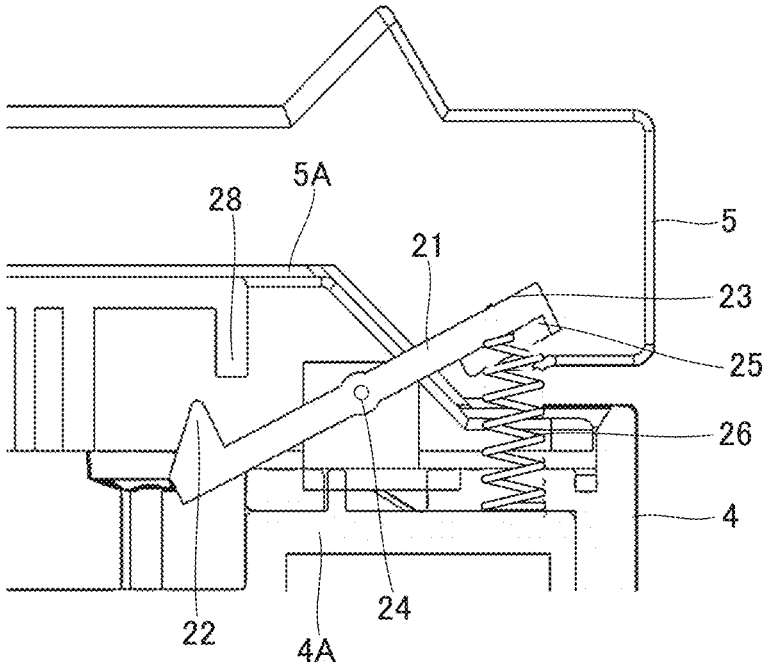
FIG. 6A is a cross-sectional view illustrating a state in which an operation part of a lever has not been operated.
Figure 6B:
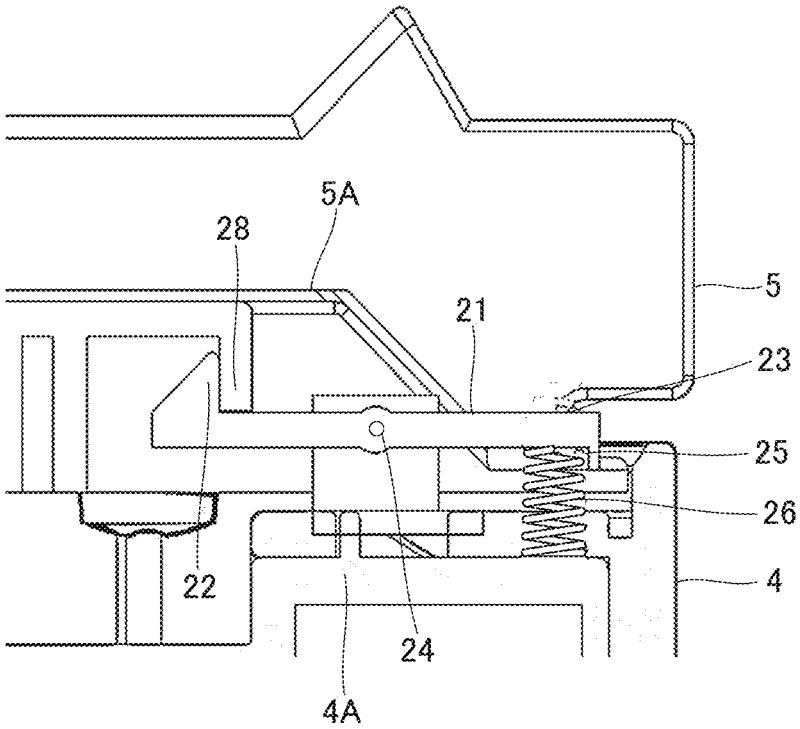
FIG. 6B is a cross-sectional view illustrating a state in which an operation part of a lever is operated and pressed.

FIGS. 6A and 6B are cross-sectional views illustrating a configuration of the vicinity of the lever 21 in a state in which both the paper feeding cassette 4 and the multi-tray 5 are pushed into the device main body 2. As illustrated in FIG. 6A, on an upper side of the frame part 4A of the paper feeding cassette 4, the lever 21 is disposed. At a left end of the lever 21, a hook 22 protruding upward is disposed upward, and a right end part of the lever 21 is set as an operation part 23.

A horizontal shaft 24 disposed in the frame part 4A of the paper feeding cassette 4 passes through the center of the lever 21, and the lever 21 is supported to be freely rotated around the horizontal shaft 24 as its center. In addition, a concave portion 25 is formed on a lower side of the operation part 23 of the lever 21, a lower end of a coil spring 26 formed from a compression spring is fixed to the frame part 4A of the paper feeding cassette 4, and an upper end of the coil spring 26 is fitted to the concave portion 25.

In the frame part 5A of the multi-tray 5, an engagement part 28 protruding downward is disposed. In a state in which both the paper feeding cassette 4 and the multi-tray 5 are pushed in and housed on the inside of the device main body 2, the hook 22 of the lever 21 disposed in the frame part 4A of the paper feeding cassette 4 is at a position slightly deviating to the inside of the device main body 2 from the engagement part 28 disposed in the frame part 5A of the multi-tray 5.

As illustrated in FIG. 6A, when the coil spring 26 is stretched, the operation part 23 is pushed up by the coil spring 26, the lever 21 rotates in a counterclockwise direction around the horizontal shaft 24, and the hook 22 falls and is separated from the engagement part 28 of the frame part 5A of the multi-tray 5.

As illustrated in FIG. 6B, when the operation part 23 is pressed down, the coil spring 26 is contracted, the lever 21 rotates in a clockwise direction around the horizontal shaft 24, and the hook 22 rises and is engaged with the engagement part 28 of the frame part 5A of the multi-tray 5. An operation for pressing down this operation part 23 is performed through the slit 3 disposed in a lower part of the opening/closing door 2A of the front face illustrated in FIG. 5B by a user.

Figure 7:
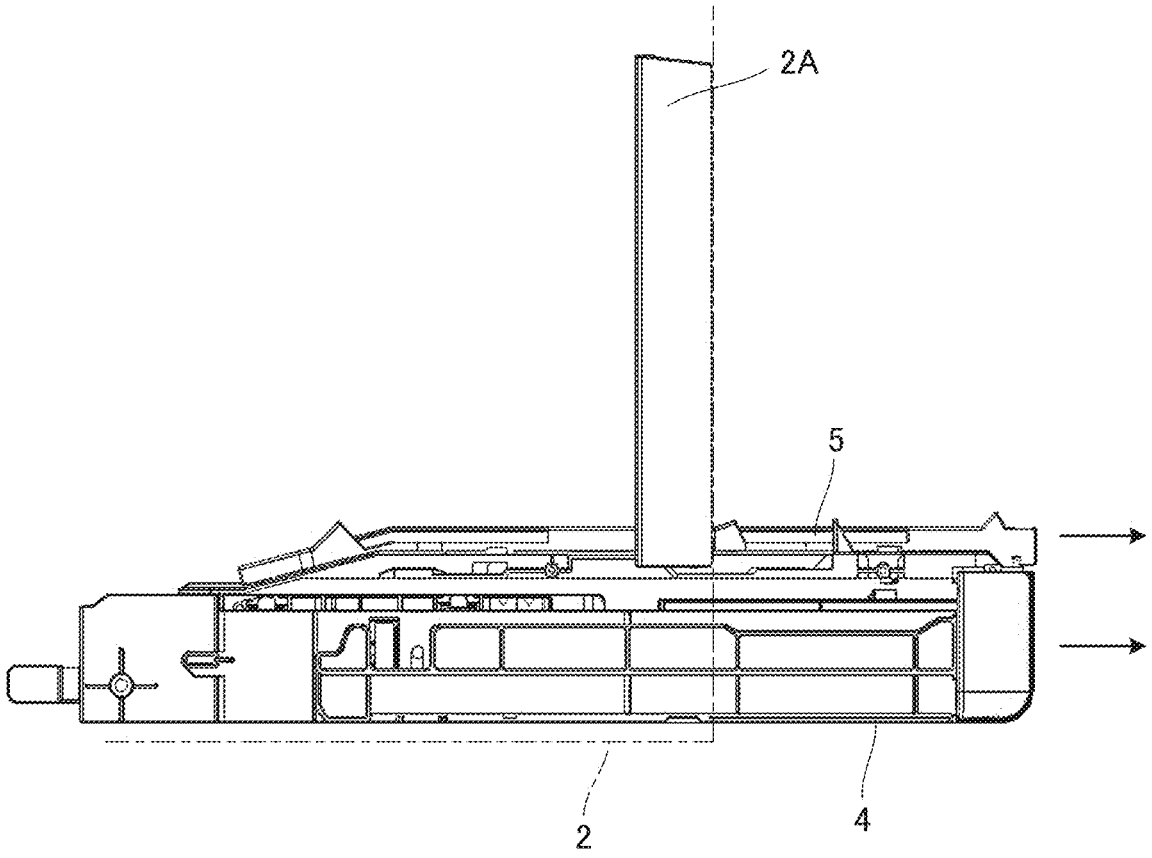
FIG. 7 is a side view illustrating a state in which both a paper feeding cassette and a multi-tray are pulled out from a device main body.

Since the hook 22 of the lever 21 disposed in the frame part 4A of the paper feeding cassette 4 is positioned on the inner side of the device main body 2 from the engagement part 28 disposed in the frame part 5A of the multi-tray 5, when the paper feeding cassette 4 is drawn out from the device main body 2 to an outer side in a state in which the hook 22 is engaged with the engagement part 28, the hook 22 is pulled along the multi-tray 5 through the engagement part 28, and, as illustrated in FIG. 7, the multi-tray 5 is drawn out from the device main body 2 to the outside together with the paper feeding cassette 4.

For example, in a case in which a recording sheet is placed in the multi-tray 5, and the recording sheet is jammed in the middle of drawing out the recording sheet using the paper feeding roller 12, after pressing down the operation part 23 of the lever 21 using his or her finger through the slit 3 of the lower part of the opening/closing door 2A of the front face, rotating the lever 21 in a clockwise direction, and engaging the hook 22 with the engagement part 28, a user draws out the paper feeding cassette 4 and draws out the multi-tray 5 together with the paper feeding cassette 4. Thus, in accordance with a drawing-out operation performed once, both the paper feeding cassette 4 and the multi-tray 5 can be drawn out.

When the paper feeding cassette 4 and the multi-tray 5 are drawn out, an empty space is formed on a lower side of the device main body 2, and thus a user can remove the jammed recording sheet through this empty space. When a user releases the operation part 23 of the lever 21, as illustrated in FIG. 6A, the operation part 23 can be pushed up in accordance with the biasing form of the coil spring 26, the lever 21 is rotated in a counterclockwise direction around the horizontal shaft 24, and the hook 22 falls to be separated away from the engagement part 28 of the frame part 5A of the multi-tray 5. In this state, the user can separate the multi-tray 5 from the paper feeding cassette 4.

In addition, when the paper feeding cassette 4 and the multi-tray 5 are to be inserted into the device main body 2, the paper feeding cassette 4 and the multi-tray 5 are inserted into the inside of the device main body 2 in a state in which the multi-tray 5 is placed in the paper feeding cassette 4. At this time, the hook 22 may be engaged with or disengaged from the engagement part 28.

Figure 8:
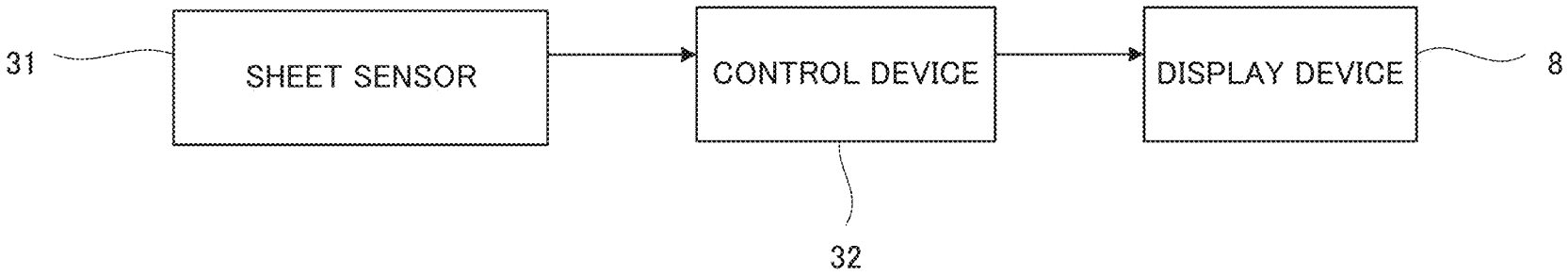
FIG. 8 is a block diagram illustrating one example of a control system of the paper feeding device according to this embodiment.

FIG. 8 is a block diagram illustrating one example of a control system of the paper feeding device 10. In FIG. 8, a sheet sensor 31 detects a recording sheet drawn out by the paper feeding roller 12. A control device 32 counts a continuation time for which a recording sheet is continuously detected by the sheet sensor 31 by receiving input of a detection output of the sheet sensor 31, and, when this continuation time becomes a specified time set in advance or more, judges a state in which the recording sheet is jammed, causes the display device 8 to display the formation of this state, and causes the display device 8 to display a message, an illustration, a moving image, and the like representing an operation sequence of drawing out both the paper feeding cassette 4 and the multi-tray 5 while pressing down the operation part 23 of the lever 21 using a finger through the slit 3 of the lower part of the opening/closing door 2A of the front face described above. By viewing the operation sequence, a user draws out and excluding the paper feeding cassette 4 and the multi-tray 5 at once and removes the jammed recording sheet.

As described above, in the paper feeding device 10 according to this embodiment, both the paper feeding cassette 4 and the multi-tray 5 can be drawn out by performing a drawing-out operation once, and thus, compared to an operation of separately drawing out a paper feeding cassette and a multi-tray in order as in a conventional case, much effort is not taken, and time saving can be achieved as well.

Furthermore, in the case of the image forming apparatus described in BACKGROUND, in multi-size cassette, sheet members of two kinds of sizes are loaded with being adjacently aligned, and thus, compared to a cassette loading sheet members of a size of one kind, the size becomes doble or more, and it is difficult to handle the multi-size cassette, and the size of the apparatus becomes large. On the other hand, in the configuration in which a paper feeding cassette and a multi-tray are arranged to vertically overlap each other, the sizes of the paper feeding cassette and the multi-tray do not need to be large, and it is appropriate for decreasing the size of the apparatus. However, in a case in which a jam in which a sheet drawn out from the multi-tray is jammed occurs, the paper feeding cassette and the multi-tray are separately drawn out in order, and the jammed sheet is excluded, and thus much effort is required.

In contrast to this, according to the embodiment described above, while the paper feeding cassette and the multi-tray are disposed to be freely inserted or extracted separately, the paper feeding cassette and the multi-tray can be drawn out and extracted at once using a simple operation.

In addition, in the embodiment described above, although a printer has been described as one embodiment of the image forming apparatus of the present disclosure as an example, it is merely one example, and the image forming apparatus may be a multi-function device, a copier, a facsimile device, or the like.

Furthermore, the configuration of the embodiment described above with reference to FIGS. 1 to 8 is merely one example of the present disclosure and is not intended to limit the present disclosure to this configuration.

While the present disclosure has been described in detail with reference to the embodiments thereof, it would be apparent to those skilled in the art that the various changes and modifications may be made therein within the scope defined by the appended claims.

What is claimed is:

1. A paper feeding device comprising:

a paper feeding cassette disposed to be freely inserted into or extracted from a device main body;

a multi-tray arranged on an upper side of the paper feeding cassette and disposed to be freely inserted into or extracted from the device main body;

a hook disposed to be freely moved in a vertical direction in the paper feeding cassette;

a biasing member disposed in the paper feeding cassette and biasing the hook to a lower side; and an engagement part disposed in the multi-tray and engaged with the hook when the hook is operated and is moved in an upward direction against a biasing force of the biasing member in a state in which the paper feeding cassette and the multi-tray are pushed into and housed on an inside of the device main body, wherein, when the paper feeding cassette is pulled out in a state in which the hook is engaged with the engagement part, the multi-tray is pulled out together with the paper feeding cassette, wherein the paper feeding device further comprising a lever operated by a user, wherein the hook is disposed upward at one end of the lever, supports center of the lever to be freely rotated around a horizontal shaft as its center by using the other end of the lever as an operation part, and rotates the lever around the horizontal shaft by moving the other end of the lever upward in accordance with the biasing force of the biasing member to bias the hook downward.

2. The paper feeding device according to claim 1, wherein the hook is not engaged with the engagement part when the other end of the lever is moved upward, and the hook is biased downward in accordance with the biasing force of the biasing member, and wherein, when the operation part of the lever is pressed to a lower side, the lever is rotated around the horizontal shaft against the biasing force of the biasing member, and one end of the lever is moved upward, the one end of the lever is moved to a position at which the hook is engaged with the engagement part.

3. The paper feeding device according to claim 1, wherein an opening/closing door is disposed as a part of a wall part on a front side of the device main body, wherein the opening/closing door is supported such that a lower end part of the wall part is freely rotated with respect to the device main body, wherein a slit for enabling the opening/closing door to be rotated with respect to the device main body is formed on the front side of the device main body, and wherein the operation part of the lever is exposed through the slit for the outside of the device main body in a state in which the opening/closing door is closed for the front side of the device main body.

4. The paper feeding device according to claim 1, wherein the hook is positioned on an inside of the device main body from the engagement part in a state in which the paper feeding cassette and the multi-tray are pushed into and housed on an inside of the device main body.

5. The paper feeding device according to claim 1, further comprising a paper pulling-out device extracting paper from the paper feeding cassette or the multi-tray and conveying the paper.

6. An image forming apparatus comprising:

the paper feeding device according to claim 1; and an image forming device forming an image on paper that is pulled out and supplied from the paper feeding cassette or the multi-tray of the paper feeding device.

7. A paper feeding device comprising:

a paper feeding cassette disposed to be freely inserted into or extracted from a device main body;

a multi-tray arranged on an upper side of the paper feeding cassette and disposed to be freely inserted into or extracted from the device main body;

a hook disposed to be freely moved in a vertical direction in the paper feeding cassette;

a biasing member disposed in the paper feeding cassette and biasing the hook to a lower side; and an engagement part disposed in the multi-tray and engaged with the hook when the hook is operated and is moved in an upward direction against a biasing force of the biasing member in a state in which the paper feeding cassette and the multi-tray are pushed into and housed on an inside of the device main body, wherein, when the paper feeding cassette is pulled out in a state in which the hook is engaged with the engagement part, the multi-tray is pulled out together with the paper feeding cassette, wherein the paper feeding device further comprising:

a display device;

a detection device detecting paper pulled out from the multi-tray; and a control device that, when a continuation time for which the paper has been continuously detected by the detection device becomes a specified time set in advance or more, judges that a state in which the paper is jammed is formed and causes the display device to display an operation method for the hook for moving the hook upward and engaging the hook with the engagement part.

* * * * *